US005879769A

United States Patent [19]

Greenland et al.

[11] Patent Number: 5,879,769

[45] Date of Patent: Mar. 9, 1999

[54] SAMPLER DEVICE HAVING A REINFORCED COMPARTMENT AND METHOD OF PACKAGING SAMPLE MATERIAL

[75] Inventors: Steven Jeffrey Greenland, Hixson; Lyudmila Feldman, Signal Mountain, both of Tenn.

[73] Assignee: Arcade, Inc., Chattanooga, Tenn.

[21] Appl. No.: 712,779

[22] Filed: Sep. 12, 1996

[51] Int. Cl.[6] ..... B29D 22/00

[52] U.S. Cl. ..... 428/35.7; 428/35.2; 428/36.1; 428/36.2; 206/581; 206/461; 206/462; 206/469

[58] Field of Search ..... 206/581, 461, 206/462, 469; 428/35.7, 35.2, 36.1, 36.2

[56] References Cited

U.S. PATENT DOCUMENTS

| | | | |
|---|---|---|---|
| 2,061,139 | 11/1936 | Cohen | 206/82 |
| 2,185,386 | 1/1940 | Valentine | 132/78.5 |
| 2,214,510 | 9/1940 | Robinson | 132/79 |
| 2,291,379 | 7/1942 | D'Alelio | 215/1 |
| 2,561,400 | 7/1951 | Morrell | 132/79 |
| 2,878,061 | 3/1959 | Saeks | 299/24 |
| 3,421,615 | 1/1969 | Salzer et al. | 206/44.12 |
| 4,145,001 | 3/1979 | Weyenberg et al. | 239/56 |
| 4,430,843 | 2/1984 | Favale | 53/410 |
| 4,614,299 | 9/1986 | Van Loveren et al. | 239/6 |
| 4,687,476 | 8/1987 | Pailin | 604/307 |
| 4,751,934 | 6/1988 | Moir et al. | 132/79 D |
| 4,769,262 | 9/1988 | Ferrar et al. | 428/35 |
| 4,824,143 | 4/1989 | Grainger | 283/56 |
| 4,848,378 | 7/1989 | Moir et al. | 132/319 |
| 4,874,129 | 10/1989 | DiSapio et al. | 239/36 |
| 4,876,136 | 10/1989 | Chang et al. | 428/130 |
| 4,878,775 | 11/1989 | Norbury et al. | 401/132 |
| 4,884,680 | 12/1989 | Israel et al. | 206/44.11 |
| 4,890,872 | 1/1990 | Parrotta et al. | 283/56 |
| 4,961,493 | 10/1990 | Kaihatsu | 206/0.5 |
| 4,998,621 | 3/1991 | Meehan | 206/466 |
| 4,998,671 | 3/1991 | Leifheit | 239/44 |
| 5,037,139 | 8/1991 | Schoenleber et al. | 283/56 |
| 5,072,831 | 12/1991 | Parrotta et al. | 206/232 |
| 5,161,688 | 11/1992 | Muchin | 206/484 |
| 5,192,386 | 3/1993 | Moir et al. | 156/268 |
| 5,248,537 | 9/1993 | Giannavola | 428/40 |
| 5,439,100 | 8/1995 | Gordon et al. | 206/0.5 |
| 5,439,172 | 8/1995 | Comyn et al. | 239/34 |
| 5,647,941 | 7/1997 | Gunderman et al. | 156/277 |
| 5,690,130 | 11/1997 | Gunderman et al. | 132/319 |
| 5,704,481 | 1/1998 | Lutz | 206/484 |
| 5,718,955 | 2/1998 | McGuire et al. | 428/35.7 |

*Primary Examiner*—Nam Nguyen
*Assistant Examiner*—Steven H. Ver Steeg
*Attorney, Agent, or Firm*—Pennie & Edmonds LLP

[57] ABSTRACT

A sampler device having an upper compartment layer; a lower compartment layer; a seal attaching the upper compartment layer to the lower compartment layer, wherein the upper and lower compartment layers and the seal form a compartment or compartments, for containing sample material; and a reinforcement layer for protecting the compartment. The present invention also relates to an easy, inexpensive and reliable method of packaging sample material.

24 Claims, 9 Drawing Sheets

SAMPLER DEVICE HAVING A REINFORCED COMPARTMENT AND METHOD OF PACKAGING SAMPLE MATERIAL

FIELD OF INVENTION

The present invention relates generally to a sampler device and more specifically to a sampler device comprising two layers of material for containing sample material in a sealed compartment between them and an integral reinforcement layer for protecting the sample material, all joined together in one unified or unitized structure. The present invention also relates to a method of packaging sample material.

BACKGROUND OF INVENTION

Manufacturers of a variety of products, such as medical treatments and cosmetics, often distribute samplers containing small quantities or samples of their products to their current or potential customers. For example, manufacturers in the cosmetic industry often obtain customers by offering samples of their products. This is particularly common in the perfume industry. Such samplers are often distributed by hand to individual shoppers in stores. They are also affixed to the pages of publications such as advertising catalogs and magazines which are distributed to potential customers.

Typically, such samplers consist of a flexible pouch or envelope, in which a small quantity of a sample material is sealed between two flexible barrier sheets or between the folds of a single sheet. These pouches are subjected to sizable mechanical forces and are susceptible to leaking and bursting. Samplers having a peelable seal as opposed to a permanent seal are particularly prone to these problems. Therefore, the material chosen to fabricate such pouches must be strong enough to endure transportation and handling without leaking or bursting, and this requirement substantially limits the selection of materials to those of heavier construction. Pouches fabricated of these materials must be made with a strong permanent seal and therefore must be torn or cut to open. Such samplers are not user-friendly. The geometry of these pouches also limits the amount of sample material that may be placed inside the pouch while avoiding leaking and bursting. "Head space" or air within the pouch will limit this amount even further.

Several types of specialty samplers are known in the art. For example, U.S. Pat. No. 4,998,621 to Meehan discloses a package and packing method for a liquid cosmetic sample in which a structurally non-self-sustaining pouch containing the sample material is protected by a rigid carrier sheet that is folded over the pouch. The carrier sheet incorporates a cutout or opening within which the pouch is positioned to fall. The pouch is detachably secured to the carrier, and the user must pull the pouch from the carrier through the cutout in order to sample the cosmetic.

The Meehan design is intended to protect the pouch from "squeezing forces" that occur when external force is applied to the package. Such forces routinely occur when a number of packages are stacked upon one another. However, in order to pull the pouch out of the protective enclosure of the carrier sheet, a user may well hold and squeeze the very area that requires protection. Furthermore, the Meehan package is not suitable for binding into printed publications and requires a costly manufacturing process. In addition, the cutout of the carrier detracts from the aesthetic appearance of the package.

In addition, U.S. Pat. No. 5,161,688 to Muchin discloses a cosmetic sampler in which a cosmetic sample is enclosed in a retaining cavity contained in the sampler. A hole is punched through a base ply having two opposing surfaces, and the base ply is adhesively joined at one surface to a closure ply, thereby defining a retaining cavity into which the sample is deposited. The cavity and the sample material within is covered with a film ply, which is adhesively attached to the second surface of the base ply. The cosmetic sample is therefore retained by three plies and two adhesive layers attaching the plies to each other.

There are problems associated with the Muchin design. Because all three plies and the adhesive are in direct contact with the sample material, all materials comprising these elements must be compatible with the sample material and suitable to contain it. The materials should not, for example, contain plasticizers, oxidizing agents, or other migrating components that would affect, degrade or destabilize the sample material or shorten its shelf life. Conversely, the materials chosen should not be adversely affected by the sample material or by components of the sample material. Materials meeting these stringent requirements may be costly. In addition, the base ply must be of a substantial thickness in order to adequately contain the sample material, and this requirement contributes to the cost of this design. Another problem associated with this design relates to the integrity and reliability of the sampler. The Muchin sampler includes two closure seams. Each additional seam increases the difficulty in maintaining manufacturing process variables.

In addition, U.S. Pat. No. 4,884,680 to Israel et al. discloses a cosmetic display in which cosmetic material is enclosed in a plurality of recesses defined by donut shaped sections which are attached to a base sheet or ply. The cosmetic material is covered by transparent film which is adhesively attached to the donut shaped sections. The sample material is therefore retained by the base sheet, the donut shaped display sections, the protective film and the adhesive joining these elements. This configuration is similar to that of the Muchin sampler and therefore has similar problems. In addition, the Israel cosmetic display is not suitable for containing fluid samples.

There is therefore a need for a sampler device of maximized efficiency that provides a compartment within a cavity to contain the sample material; incorporates a unitized structure; includes a user-friendly design with a peelable seal; provides protection against bursting while maximizing use of available space; minimizes material compatibility problems; and may be attached easily to a separate carrier such as an advertising medium while providing an attractive appearance. In addition, there is a need for a method of packaging sample material that will minimize process variables and provide production reliability.

SUMMARY AND OBJECTS OF THE INVENTION

The present invention relates to a sampler device having three major elements: a reinforcement layer having a sidewall that defines the protected volume of a compartment containing sample material; a lower compartment layer attached to the reinforcement layer and conforming to the contours of the sidewall; and an upper compartment layer sealed to the lower compartment layer to form the compartment for containing the sample material.

The present invention also relates to a method of packaging sample material comprising four major steps: forming a reinforcement layer having a sidewall that defines a cavity or enclosure; securely attaching a lower compartment layer to the reinforcement layer, such that a portion of the lower compartment layer fits within the cavity and conforms to the contours of the cavity; depositing sample material onto the portion of the lower compartment layer within the cavity; and sealing an upper compartment layer to the lower compartment layer around the sample material.

The present invention also relates to a sampler device comprising an upper compartment layer, a lower compartment layer, a seal attaching the upper compartment layer to the lower compartment layer, thereby forming at least one closed compartment for containing sample material, and at least one reinforcement layer conformably attached to at least one of the upper compartment layer and the lower compartment layer to protect the at least one compartment, wherein the at least one reinforcement layer defines an enclosure which contains substantially all of the at least one compartment.

The present invention also relates to a sampler device comprising an upper compartment layer, a lower compartment layer, a seal attaching the upper compartment layer to the lower compartment layer, thereby forming a closed compartment for containing sample material, and at least one reinforcement layer to protect the compartment, wherein the at least one reinforcement layer has a sidewall defining an enclosure which contains substantially all of the compartment and wherein at least one of the upper compartment layer and the lower compartment layer is attached to substantially the entire sidewall of the at least one reinforcement layer.

It is an object of the present invention to provide a sampler device for storing sample material, such as treatments, cosmetic products, personal care products, foods, beverages and other dry, liquid or semi-liquid products or materials, in a sealed compartment that is resistant to leakage, absorption and permeation of the sample material. It is another object of the present invention to provide a sampler device that preserves the properties of the contained material in its intended form and protects the material from the environment. It is a further object of the present invention to provide a sampler device that incorporates a user-friendly, peelable seal.

It is also an object of the present invention to provide a sampler device having a reinforcement means to provide comprehensive protection for the sample material, wherein the reinforcement means is an integral part of the sampler device.

It is also an object of the present invention to minimize the use of expensive materials.

It is also an object of the present invention to provide a sampler device that maximizes the use of available space per given area and amount of material that can be stored.

It is yet another object of the present invention to provide a simple method of packaging sample material that allows a manufacturer to produce large numbers of sampler devices quickly, inexpensively and reliably.

It is further an object of the present invention to provide a sampler device that is easy and inexpensive to machine manufacture in a single pass.

It is further an object of the present invention to provide a sampler device that may be attached and registered automatically to a printed advertising carrier.

Yet another object of the invention is to provide a sampler device that may be attached to a carrier through the use of standard label affixing equipment and distributed without the need for additional packing.

Yet a further object of the invention is to provide a sampler device that may be easily produced on a carrier, which may be wound into a continuous roll.

Another object is to provide a sampler device upon which advertising art work can be attractively and advantageously displayed.

Another object is to provide a method of packaging sample material that is fast, efficient, economical and reliable.

Yet another object is to provide a mass production method of packaging sample material.

BRIEF DESCRIPTION OF THE DRAWINGS

Reference is next made to a brief description of the drawings, which are intended to illustrate a first embodiment and a number of alternative embodiments of the sampler device according to the present invention. The drawings and detailed descriptions which follow are intended to be merely illustrative, and are not intended to limit the scope of the invention as set forth in the appended claims.

DETAILED DESCRIPTION OF THE SAMPLER DEVICE

Figure 1:
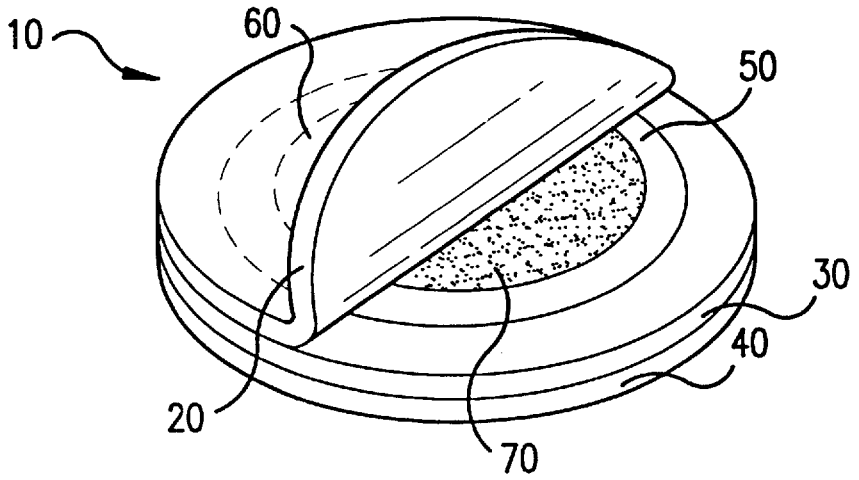
FIG. 1 is a perspective view of a first embodiment of the sampler device according to the present invention.
Figure 2A:
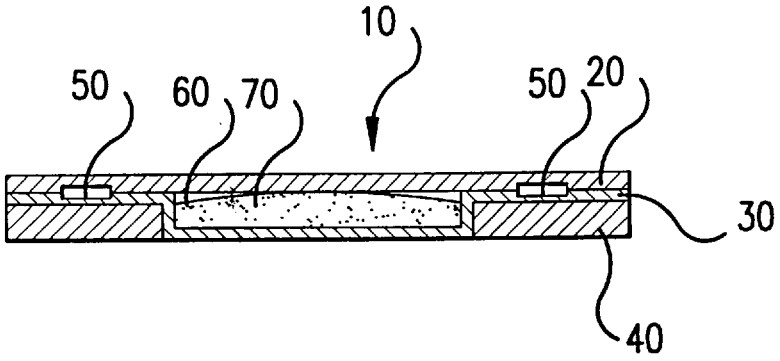
FIG. 2A is a cross-sectional view of the sampler device shown in FIG. 1.
Figure 2B:
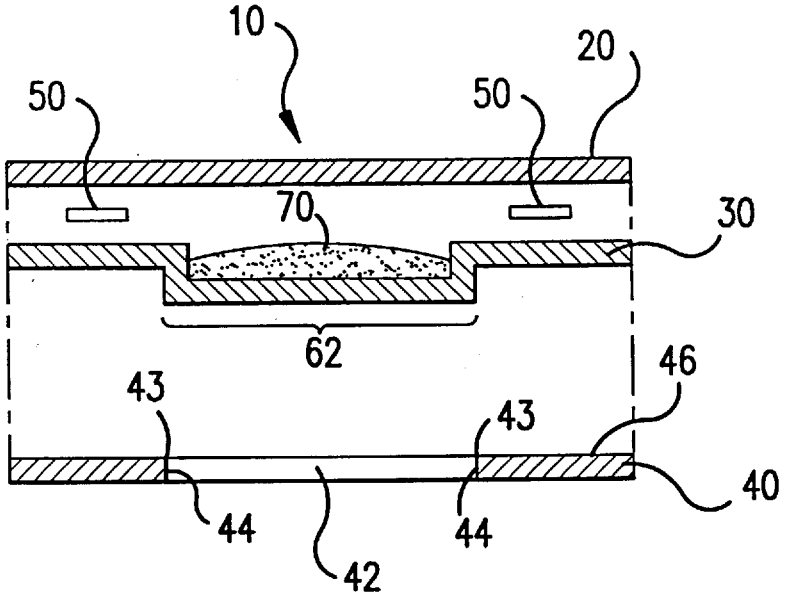
FIG. 2B is an exploded view of the sampler device shown in FIG. 2A.

Referring more particularly to the drawings, FIGS. 1, 2A and 2B represent a sampler device 10 according to a first embodiment of the present invention. As shown in FIG. 1, the sampler device 10 comprises an upper compartment layer 20, which is attached to a lower compartment layer 30, which in turn is attached to a reinforcement layer 40. A seal 50 joins the upper compartment layer 20 to the lower compartment layer 30, thus forming a compartment 60 for holding the sample material 70.

As shown in FIG. 2B, the reinforcement layer 40 has an upper surface 46, a sidewall 44, having an outer periphery 43, and a cavity 42 extending throughout the entire thickness of the reinforcement layer 40. The sidewall 44 is perpendicular to the upper surface 46 of the reinforcement layer 40 although it may be angled in an alternative embodiment. In this embodiment, the outer periphery 43 is circular. Alternatively, the outer periphery 43 may be a variety of shapes, such as, but not limited to, oval, circular, elliptical, triangular, rectangular, hexagonal and star-shaped. It may be symmetrical or asymmetrical.

In the first embodiment of the sampler device 10, the reinforcement layer 40 is made from a sheet of pressure sensitive stock, which is die cut to form the cavity 42. Pressure sensitive stock is well known in the art and generally comprises a base having two opposed surfaces and a release liner attached to one of these surfaces with a layer of pressure sensitive adhesive. The pressure sensitive adhesive may be used to attach the sampler device to a separate carrier such as a page in a magazine (see, for example, FIG. 4). The pressure sensitive stock also may include a second release liner attached to the second surface of the base by a second layer of pressure sensitive adhesive. This second layer of pressure sensitive adhesive may be used to attach the reinforcement layer 40 to the lower compartment layer 30.

Because the reinforcement layer 40 does not contact the sample material 70, no special characteristics, other than mechanical, are required. Therefore, the reinforcement layer 40 may be made from a variety of materials, many of which are inexpensive and readily available. For example, the reinforcement layer 40 may be made of any type of plastic, including filled, porous, and semi-porous; foam-like materials; a non-woven material, including paper or paperboard; a laminate; or other materials having a composite or non-composite structure. Paper products are preferred because they are inexpensive. The least expensive stock manufactured from the lowest grades of fiber may be used, and no special surface treatment or coloration is required. When the reinforcement layer 40 is made from a rigid material, it may protect the sample material 70 from twisting and bending forces in addition to squeezing forces.

Figure 3:
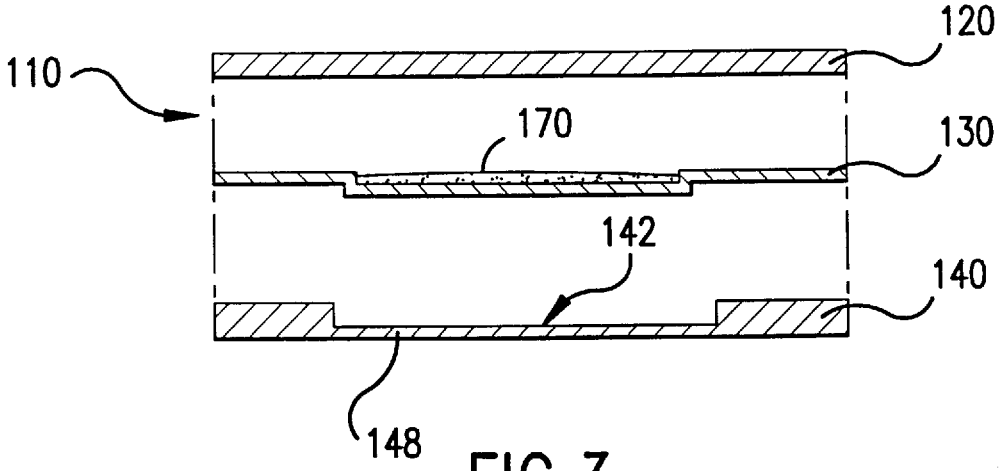
FIG. 3 is an exploded view of an alternative embodiment of the sampler device, having a reinforcement layer with an indent.

In the alternative embodiment shown in FIG. 3, there is an indent 142 in the reinforcement layer 140 instead of a cavity extending throughout the entire thickness of the reinforcement layer. The portion of the reinforcement layer 140 that is not cut away forms a base support 148, which provides additional support or protection for the sample material 170. In this sampler device 110, the lower compartment layer 130 is attached to the reinforcement layer 140 such that it conforms to the contours of the indent 142. Similar to the first embodiment, the sample material 170 is enclosed in a compartment between the upper compartment layer 120 and the lower compartment layer 130.

Figure 4:
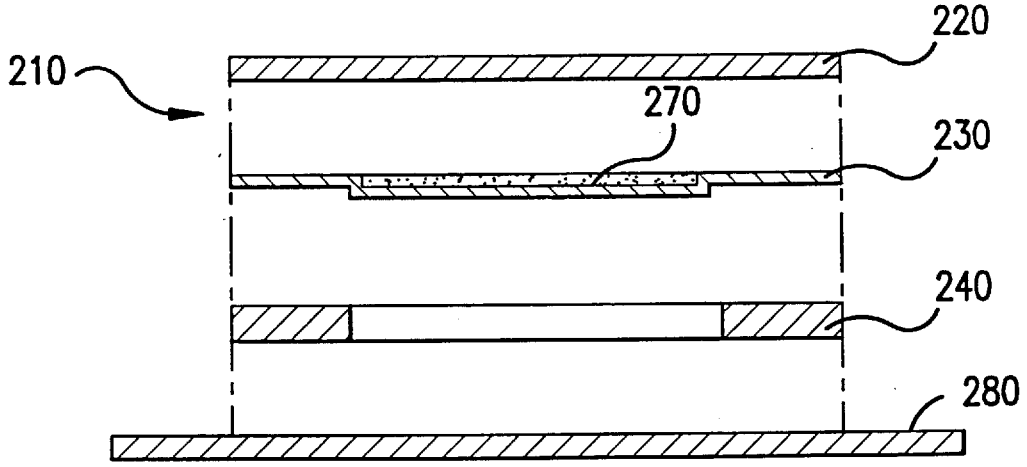
FIG. 4 is an exploded view of the sampler device with a separate carrier.

In the sampler device 210 shown in FIG. 4, additional support or protection for the sample material 270 may be provided by attaching the reinforcement layer 240 to a separate carrier 280. When the reinforcement layer 240 is made from a pressure sensitive stock, the separate carrier 280 may be the release liner of the pressure sensitive stock.

In the first embodiment, the lower compartment layer 30 is attached to the reinforcement layer 40 such that it conforms to the contours of the reinforcement layer 40 as shown in FIG. 2A. Specifically, the lower compartment layer 30 contacts and is securely attached to both the upper surface 46 and substantially the entire sidewall 44 of the reinforcement layer 40. The portion of the lower compartment layer 30 that lies within the cavity forms a well 62.

By closely conforming the lower compartment layer 30 to the sidewall 44 of the reinforcement layer 40, full advantage is taken of the space and protective capacity of the reinforcement layer 40. The quantity of sample material 70 that may be protected by the reinforcement layer 40 is defined by the dimensions of the cavity 42 and the thickness or depth of the reinforcement layer 40.

In alternative embodiments, the lower compartment layer 30 may conform less closely to the contours of the reinforcement layer 40. In other words, only a portion of the sidewall 44 may be attached to the lower compartment layer 30. In the alternative embodiment shown in FIG. 3, only a portion of the lower compartment layer 130 may be attached to the base support 148. Likewise, in the alternative embodiment shown in FIG. 4, only a portion of the lower compartment layer 230 may be attached to the separate carrier 280.

In the first embodiment, the lower compartment layer 30 also is made from a sheet of pressure sensitive stock, comprising a base, a release liner and pressure sensitive adhesive as described above. To attach the lower compartment layer 30 to the reinforcement layer 40, the release liner of the pressure sensitive stock is removed, and the base is attached to the reinforcement layer 40 by the layer of pressure sensitive adhesive on the base. The base of the lower compartment layer 30 is pressed firmly against the upper surface 46 and the sidewall 44 of the reinforcement layer 40 such that the lower compartment layer 30 closely conforms to the contours of the reinforcement layer 40. Alternatively, the attachment between the reinforcement layer 40 and the lower compartment layer 30 may be effected by an adhesive other than a pressure sensitive adhesive or by an alternative attachment means known in the art.

The lower compartment layer 30 may be made from a variety of alternative materials as long as the following requirements are met. Firstly, the material must have "barrier properties." This means that the material must provide an adequate barrier for the sample material 70. Not only must it prevent the sample material 70 and its components from migrating to the outside of the compartment 60, but it also must protect the sample material 70 from the environment. Secondly, the material must be sufficiently flexible to conform to the shape of the reinforcement layer 40 and the cavity 42. Additionally, to ensure that the sample material 70 will be preserved in its original form, the material composing the lower compartment layer 30 must not interact with the sample material 70. For sample material comprising medical treatments, it is critical for patients to receive these treatments unadulterated by their packaging. Cosmetic companies also want potential customers to sample cosmetics in their intended commercial form. Many appropriate materials are readily available and can be obtained off-the-shelf.

As shown in FIGS. 1 and 2A, the upper compartment layer 20 is attached to the lower compartment layer 30 by the seal 50. The upper and lower compartment layers 20, 30 form a compartment 60, closed by the seal 50, for storing and preserving the sample material 70. Preferably, the compartment 60 will be filled with as much sample material 70 as the dimensions of the compartment 60 will allow without causing the upper compartment layer 20 to bulge. Although the upper compartment layer 20 may be made of a flexible material that will accommodate bulging due to an extra amount of sample material 70, this extra amount may weaken the device's resistance to bursting and leaking.

The upper compartment layer 20 is made from a flexible sheet of material. A wide variety of materials may appropriately be used, many of which are readily available. This material also must provide an effective barrier for the sample material 70, and it cannot interact with the sample material 70. However, unlike the lower compartment layer 30, the upper compartment layer 20 may be made from materials that are stiff or rigid. A transparent material or material having one or more transparent sections may be used so that a potential customer can view the contents of the sampler device 10. Similarly, the lower compartment layer 30 also may be made from transparent material so that a potential customer can view the contents of the sampler device from both sides of the device.

As will be readily appreciated, due to the symmetric arrangement of the upper and lower compartment layers, these layers may be reversed. In other words, the reinforcement layer 40 may be attached to the upper compartment layer 20 instead of the lower compartment layer 30. In an alternative embodiment, there may be two reinforcement layers, attached respectively to the upper compartment layer 20 and the lower compartment layer 30, thereby providing additional protection for the sample material 70.

In the first embodiment as shown in FIG. 1, the seal 50, which attaches the upper compartment layer 20 to the lower compartment layer 30, forms a substantially circular outline close to the outer periphery 43 of the cavity 42. This configuration minimizes the unprotected area of the compartment 60 and limits spreading of sample material 70 outside of the cavity 42, thereby reducing the likelihood of bursting. In addition, it is aesthetically more pleasing to view a small amount of sample material when it is confined to a small, well-defined area.

The seal 50 is a hermetic peelable seal formed by heat sealing. Hermetic seals and peelable seals are known in the art. The seal 50 also may be resealable. A hermetic seal will completely seal the compartment against the escape or entry of air. This type of seal may not be required depending on the type of sample material contained in the compartment. As an alternative to heat sealing, the seal 50 may be formed with an adhesive. Whatever adhesive means is chosen must be stable with respect to the sample material 70, i.e., it should not react or become plasticized when it comes into contact with the sample material 70 or components of the sample material 70. Such reaction may cause undesirable deterioration of the sample material 70 or the seal 50.

Alternatively, the seal 50 may be a permanent seal. Permanent seals, also referred to as destruct or tear bonds, are also known in the art. Permanent seals also may be formed by adhesives or by heat sealing. If a permanent seal is used, the sampler device 10 also must be provided with a means for opening the compartment 60, which likely will involve tearing one of the upper and lower compartment layers 20, 30. Such means are well known in the art and include a notch or a string to originate or facilitate the tear.

In alternative embodiments, the seal 50 may be formed anywhere between the upper and lower compartment layers 20, 30 as long as it joins these layers in such a way as to contain most of the sample material 70 within the cavity 42. Also, the seal 50 may form any of a variety of closed outlines such as, but not limited to circles, ovals, triangles and rectangles, which may or may not reproduce the shape of the outer periphery 43 of the cavity 42.

In addition, the width of the seal 50 may vary in alternative embodiments. If desired, the seal 50 may cover the entire area between the upper and lower compartment layers 20, 30 beyond the outer periphery of the cavity 42. In addition, multiple seals may be used. These seals may have a variety of configurations such as concentric circles, cross lines and combinations thereof, as long as at least one closed seal encircles the compartment 60.

Alternative configurations of the reinforcement layer also may be included in the sampler device of the present invention. The sidewall of the reinforcement layer may be formed by a raised wall or walls or raised segments instead of a cavity. Such an embodiment is illustrated in the sampler device 410 shown in FIGS. 5A–5C.

Figure 5A:
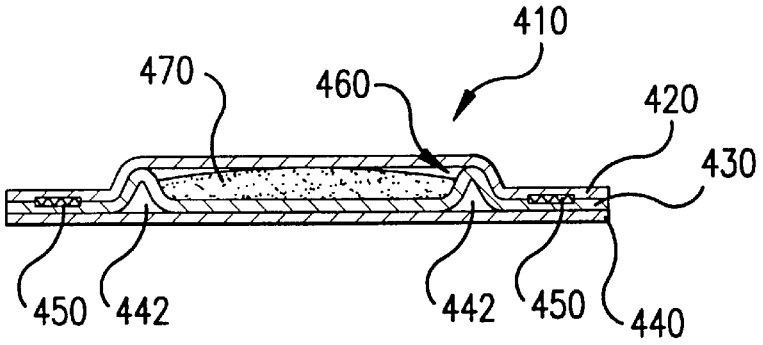
FIG. 5A is a cross-sectional view of a sampler device, having a reinforcement layer with a raised wall.
Figure 5B:
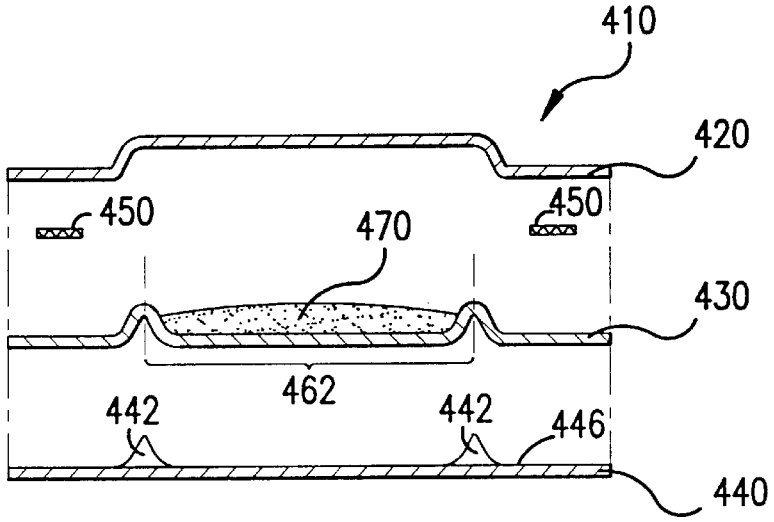
FIG. 5B is an exploded view of the sampler device shown in FIG. 5A.

As shown in FIG. 5A, the lower compartment layer 430 is attached to the reinforcement layer 440, closely conforming to both the upper surface 446 and the raised wall 442. The lower compartment layer 430 forms a well 462 within an enclosure defined by the raised wall 442. The thickness and height of the raised wall 442 is determined by the quantity of sample material 470 to be enclosed in the compartment 460 and the degree of protection desired. Sample material 470 is dispensed into the well 462, and the upper compartment layer 420 is sealed to the lower compartment layer 430 beyond the enclosure by the seal 450. As shown in FIG. 5A, the upper compartment layer 420 curves over the raised wall 442, thereby providing means for maintaining sample material 470 within the well 462 in addition to the seal 450. Alternatively, a seal may be formed along the top of the raised wall 442 in addition to the seal 450 or by itself.

The raised wall 442 may be formed by solid, filled solid, foam or felt-like materials. These materials may be applied from solution, emulsion, suspension, hot melt or oligomers, liquid or gelled, by printing, spot coating, spraying or by known transfer techniques with subsequent drying, curing or fixing if necessary. The choice of material may depend on the type of manufacturing equipment to be used.

Figure 5C:
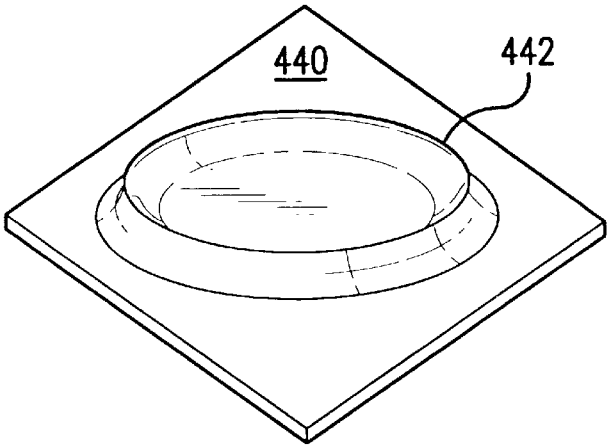
FIG. 5C is a perspective view of the reinforcement layer of the sampler device shown in FIGS. 5A and 5B.
Figure 5D:
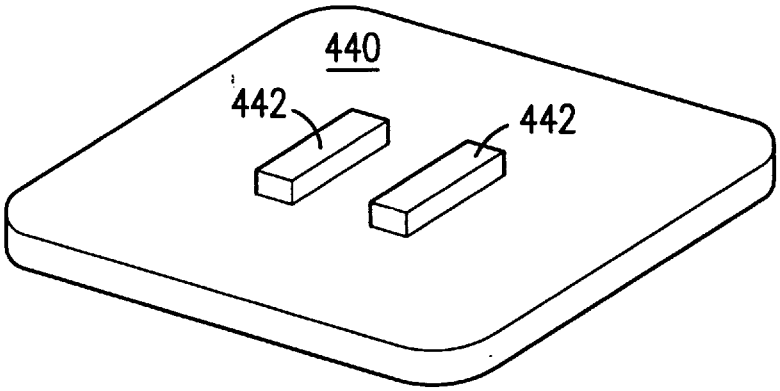
FIG. 5D is a perspective view of a reinforcement layer having a discontinuous raised wall.
Figure 5E:
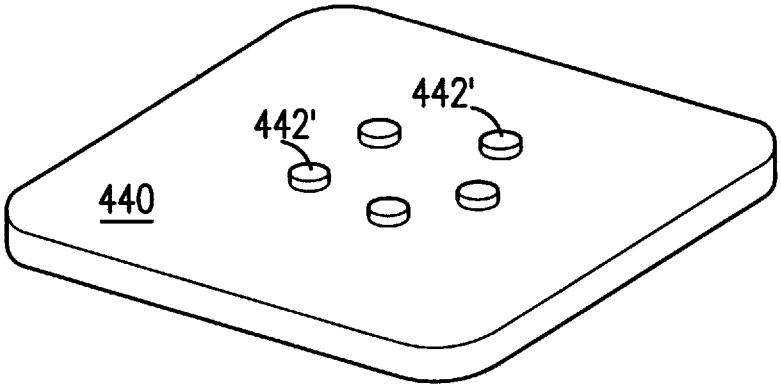
FIG. 5E is a perspective view of a reinforcement layer having circular raised segments.

The raised wall 442 of the reinforcement layer 440 may form any of a variety of alternative patterns. It does not have to be continuous, nor does it have to encircle the sample material 470. For example, the raised wall 442 may comprise two raised straight segments as shown in FIG. 5D, or circular raised segments 442' arranged in a pentagonal pattern as shown in FIG. 5E. Alternatively, raised walls or elements may be formed outside or inside the cavity. It may be beneficial to place raised elements inside large cavities for additional reinforcement.

Figure 6A:
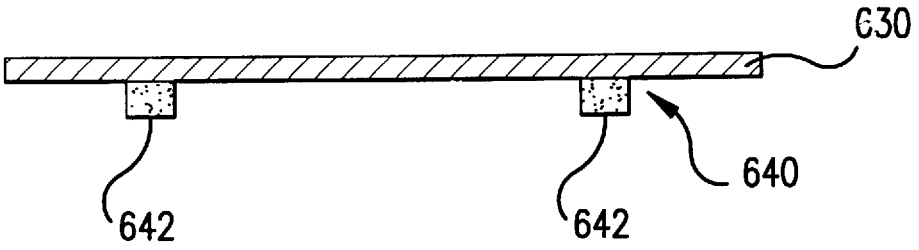
FIG. 6A is a cross-sectional view of a reinforcement layer comprising raised walls formed on a lower compartment layer.
Figure 6B:
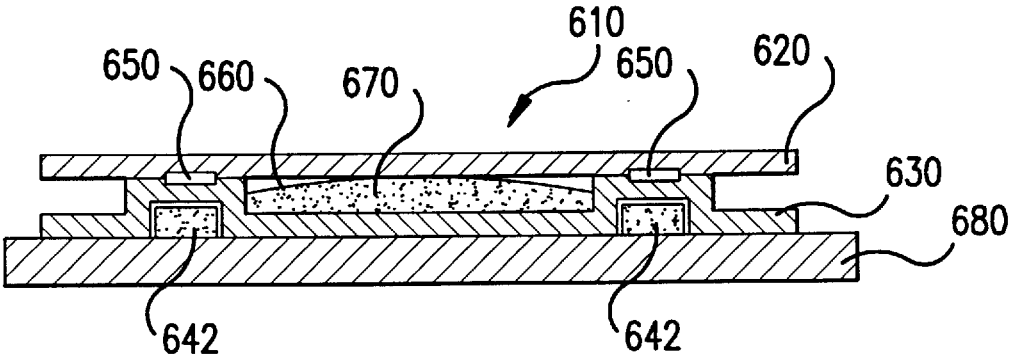
FIG. 6B is a cross-sectional view of an alternative embodiment of the sampler device, including the reinforcement layer and lower compartment layer shown in FIG. 6A.
Figure 6C:
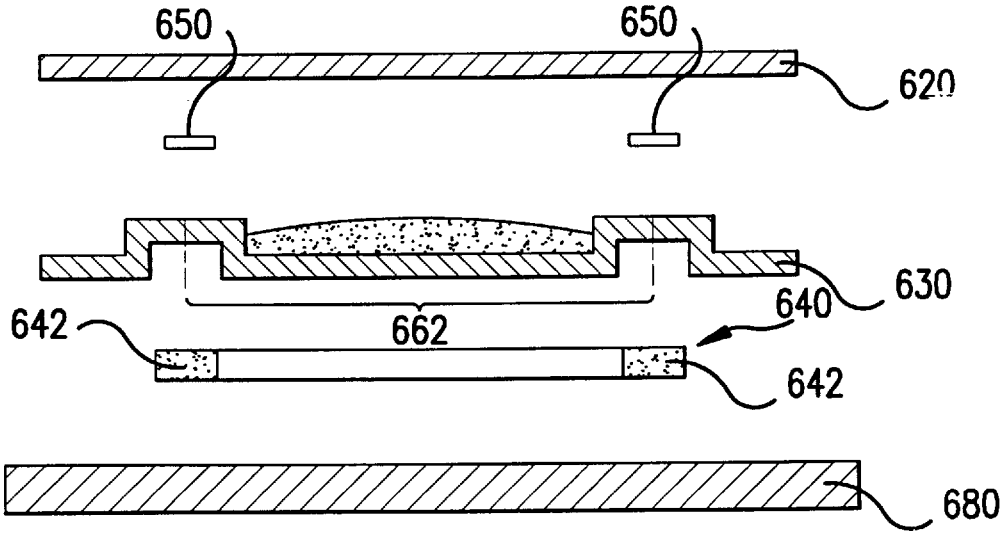
FIG. 6C is an exploded view of the sampler device shown in FIG. 6B.

In the alternative embodiment of the sampler device 610 shown in FIGS. 6A–6C, the reinforcement layer 640 comprises raised walls 642 which are formed directly on the bottom surface of the lower compartment layer 630. Similar to the embodiment shown in FIGS. 5A–5C and as shown in FIG. 6B, the lower compartment layer 630 is made to conform to the raised walls 642, thereby forming a well 662 into which sample material 670 is deposited. The upper compartment layer 620 is attached to the lower compartment layer 630 by means of the seal 650, thereby forming a compartment 660 for containing the sample material 670. The lower compartment layer 642 and the reinforcement layer 640 are attached to a carrier 680.

Figure 7A:
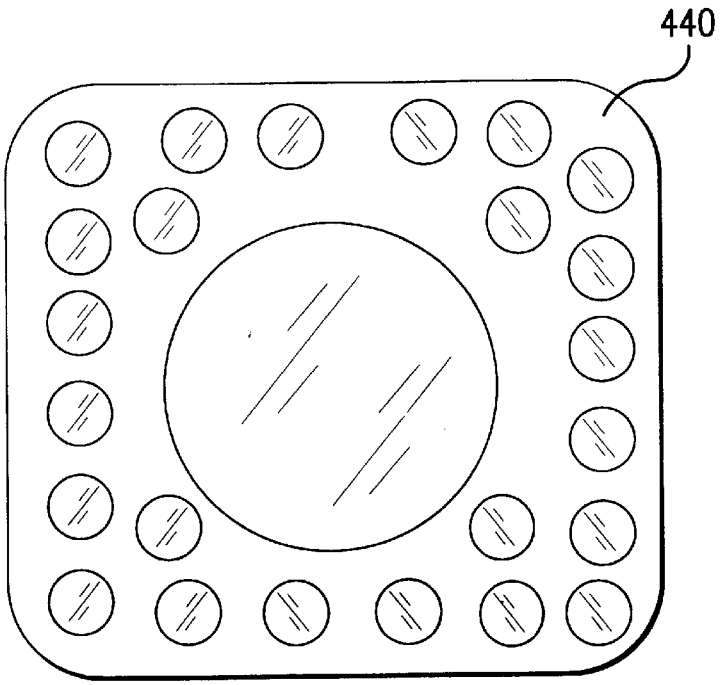
FIG. 7A is a top view of a reinforcement layer that is perforated with holes.
Figure 7B:
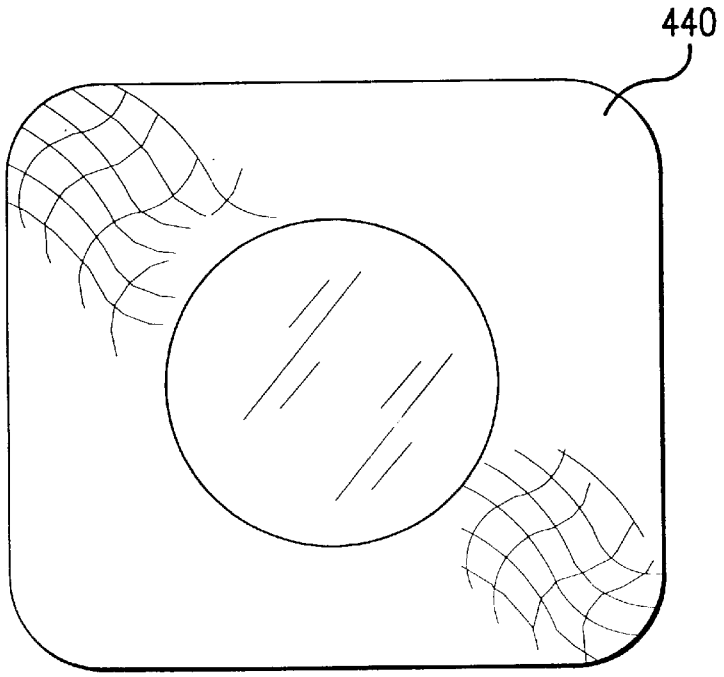
FIG. 7B is a top view of a mesh-like reinforcement layer.

To provide flexibility, the reinforcement layer 440 may be mesh-like, scored or perforated with holes (see FIGS. 7A and 7B). Such sheets or meshes are well known in the art and are often available in pre-manufactured form.

Figure 8:
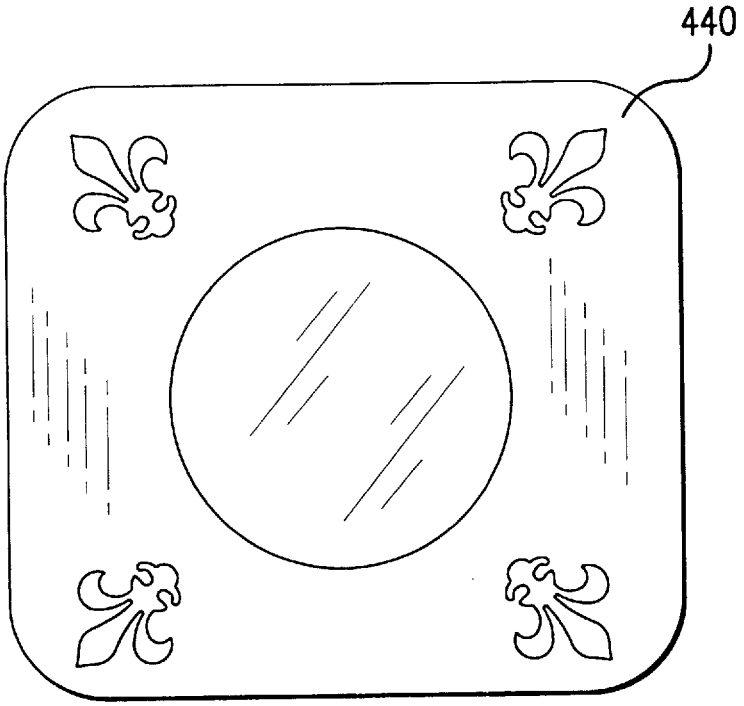
FIG. 8 is a top view of a reinforcement layer with debossed ornamentation.
Figure 9:
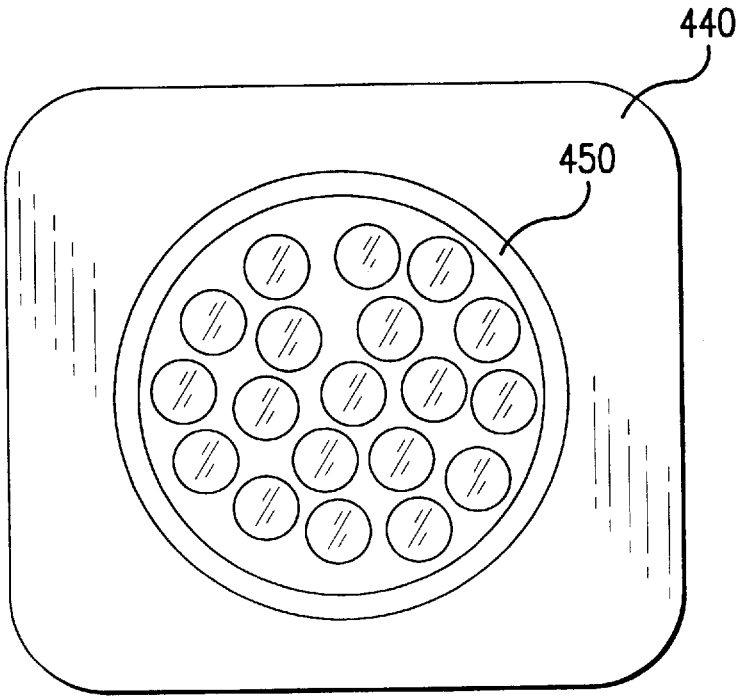
FIG. 9 is a top view of a reinforcement layer having multiple cavities.

Alternatively, the reinforcement layer 440 may be decorated with ornamental cavities or raised shapes to create a pleasing aesthetic effect (see FIG. 8). These shapes may be within or beyond the seal. The reinforcement layer also may have multiple cavities (see FIG. 9). These cavities may be disconnected from one another as shown in FIG. 9 or connected to each other or a combination of both. The lower compartment layer conforms to the contours of at least one of these cavities, thereby forming at least one well. Sample material may completely or partially fill every well or less than all of the wells. One seal 450 may surround all the cavities. Alternatively, each cavity or subsets of cavities may be sealed individually.

Figure 10A:
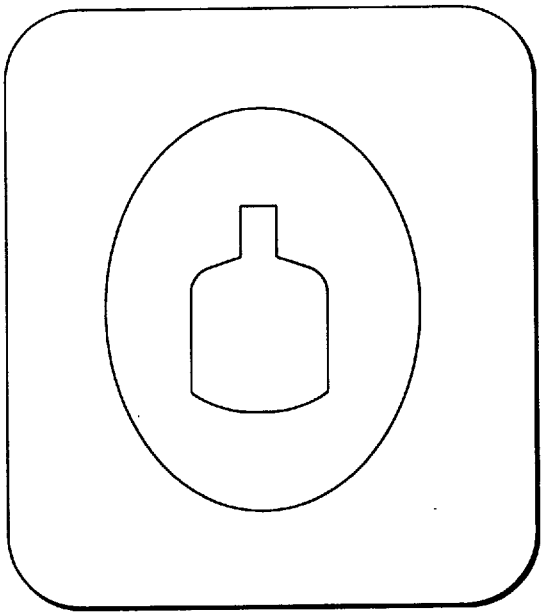
FIG. 10A is a top view of a reinforcement layer of an alternative embodiment having a multi-level compartment.
Figure 10B:
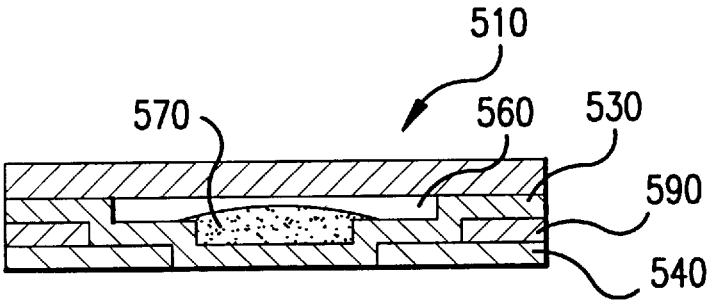
FIG. 10B is a cross-sectional view of the alternative embodiment shown in FIG. 10A.

In the alternative embodiment shown in FIGS. 10A and 10B, the sampler device 510 has a multi-level compartment 560. The multi-level compartment for containing sample material 570 is created by two reinforcement layers 540, 590 joined together. The lower compartment layer 530 conforms to the contours of both reinforcement layers 540, 590.

Art work or advertisements may be attractively and advantageously displayed on the sampler device of the present invention. The configuration of the sampler device allows an uninterrupted display of art work or ads, which may be printed on any combination of the upper compartment, lower compartment and reinforcement layers 20, 30, 40. All components of the present invention together provide a substantially continuous surface to print a complete advertisement or work of art.

DETAILED DESCRIPTION OF THE METHOD OF PACKAGING SAMPLE MATERIAL

The present invention also relates to methods of packaging sample material. The methods of the present invention generally include the following steps: forming a reinforcement layer having a sidewall that defines a cavity or enclosure; securely attaching a lower compartment layer to the reinforcement layer such that a portion of the lower compartment layer fits within the cavity and conforms to the contours of the cavity; depositing sample material onto the portion of the lower compartment layer within the cavity; and sealing an upper compartment layer to the lower compartment layer around the sample material.

In the first method of packaging sample material, the reinforcement layer 40 (such as is shown in FIGS. 1, 2A and 2B) is formed by die cutting a first sheet or layer of pressure sensitive stock in a manner known in the art to form a cavity 42 with an outer periphery 43 and a sidewall 44 extending throughout the thickness of the first sheet of pressure sensitive stock except for the release liner. The outer periphery 43 of the cavity 42 may be any of a variety of shapes.

The lower compartment layer 30 is made from a second sheet of pressure sensitive stock. The release liner of the second sheet is removed, and the lower compartment layer 30 is placed over the reinforcement layer 40 such that the pressure sensitive adhesive on the lower compartment layer 30 contacts the reinforcement layer 40 and also such that a portion of the lower compartment layer 30 lies within the cavity 42 of the reinforcement layer 40, thereby forming a well 62.

The lower compartment layer 30 is made to conform to the cavity 42 of the reinforcement layer 40. In other words, the lower compartment layer 30 is securely attached to both the upper surface 46 and the sidewall 44 of the reinforcement layer 40. In the sampler device 10 shown in FIG. 2A, the lower compartment layer 30 is attached to substantially the entire sidewall 44 of the reinforcement layer 40. However, the objects of the present invention may be achieved by attaching only a portion of the well 62 must be attached to the sidewall 44. This is effected by passing the two layers though a set of rubber rollers. Alternatively, other equipment may be used such as ironing dies, brushes, pads or air nozzles. The brushes may be magnetic, or they may be made of fibers. The pressure sensitive stock composing the lower compartment layer 30 is a flexible sheet and will therefore closely follow the contours of the cavity 42 of the first sheet.

The next step is to deposit sample material 70 into the well 62 of the lower compartment layer 30. Preferably, the amount of sample material 70 deposited outside the well 62 is minimized. The amount of sample material 70 is determined by the dimensions of the sampler device 10, which may vary widely. A preferred amount of sample material 70 for each sampler device 10 is 50 mg to 3000 mg. However, the amount of sample material is not limited to this range. A third sheet of material, i.e., the upper compartment layer 20, is then placed over the lower compartment layer 30 and the sample material 70. Because both the upper and lower compartment layers 20, 30 directly contact the sample material 70, both must have barrier properties.

Finally, the upper compartment layer 20 is attached to the lower compartment layer 30 by known methods of heat sealing. The seal 50 is formed just beyond the outer periphery 43 of the cavity 42 in order to maintain as much of the sample material 70 within the cavity 62 as possible for purposes of protection and aesthetic appearance as explained above. Sealing the upper and lower compartment layers 20, 30 encloses the sample material 70 within the compartment 60 in which it will be protected and preserved until used.

The three layers further may be cut or trimmed in a predetermined shape to form individual label-like sampler devices 10. Waste matrix is removed while the release liner of the reinforcement layer 40 is left intact. Alternatively, the release liner is removed and replaced with a separate carrier 280 (as shown in FIG. 4) via the pressure sensitive adhesive of the reinforcement layer 40. The sampler device 10 may then be distributed in this form. If the material chosen for the reinforcement layer 40 or lower compartment layer does not include a layer of pressure sensitive adhesive, another appropriate adhesive may be used.

In an alternative method of packaging sample material, raised walls are formed on a base layer to form the reinforcement layer. Reinforcement layers formed in this way are illustrated in FIGS. 5C, 5D and 5E. The raised walls 442 or raised segments 442' may be printed, spot coated, sprayed or selectively transferred to the base layer. These raised walls 442 and raised segments 442' define enclosures which function to protect the sample material 470. The lower compartment layer 430 is then attached to the reinforcement layer 440 such that it conforms to the raised walls 442 or raised segments 442' on the reinforcement layer 440. Sample material 470 is deposited on the lower compartment layer 430 such that substantially all of the sample material 470 is contained within the protective enclosure. The upper compartment layer 420 is then sealed to the lower compartment layer 430, thereby maintaining the sample material 470 within a protected compartment. The remaining steps in this alternative method are substantially similar to those of the first method.

Rather than forming raised walls or raised segments on a base layer to form a reinforcement layer, a reinforcement layer comprising raised walls or raised segments (without a base layer) may be formed directly on the lower compartment layer. This may be done by depositing material onto the surface of the lower compartment layer opposite to the surface upon which sample material is deposited. Again, these raised walls or raised segments define the protective enclosure to which the lower compartment layer conforms and in which the sample material is contained. Such a sampler device is shown in FIGS. 6A–6C.

Alternatively, the reinforcement layer may be formed from certain rigid materials that are embossed, cold formed or thermoformed to create raised walls. The lower compartment layer is then attached to this reinforcement layer such that it conforms to the raised walls. Alternatively, the lower compartment layer and the reinforcement layer may be joined as a laminate, and the laminate may be embossed or thermoformed to create the raised walls. In such a laminate, the reinforcement layer may be an olefin or other thermoplastic polymer.

An alternative method of the present invention contemplates mass production of sampler devices using standard label manufacturing equipment. This method generally includes the following steps: die cutting a first sheet or layer of pressure sensitive stock to form a plurality of cavities; permanently adhering a second flexible sheet of pressure sensitive stock over the first sheet such that portions of the second sheet lie within each cavity and conform to the contours of each cavity; depositing sample material on the second sheet, such that substantially all of the sample material lies within the cavities; placing a third sheet over the second sheet and the sample material; sealing the third sheet to the second sheet around each deposit of sample material; and die cutting the three joined sheets into individual sampler devices.

In this alternative method, the release liner of the first sheet of pressure sensitive stock remains undisturbed during the die cutting procedures. The release liner, to which each individual sampler device is attached, is one continuous sheet or web, and it may be wound in rolls, folded, or cut into sheets for subsequent processing.

When wound in rolls on a release liner, the sampler devices 10 must conform to the curvature of the rolls, and separation of the devices 10 from the release liner must be avoided. To this end, the first sheet may be scored or perforated for increased flexibility.

What is claimed:

1. A flexible sampler device comprising:

an upper compartment layer having sample barrier properties;

a lower compartment layer having sample barrier properties;

a seal attaching the upper compartment layer to the lower compartment layer, thereby forming at least one closed compartment for containing sample material; and at least one reinforcement layer conformably attached to at least one of the upper compartment layer and the lower compartment layer to protect the at least one compartment, wherein the at least one reinforcement layer defines an enclosure which contains substantially all of the at least one compartment.

2. The sampler device according to claim 1, wherein at least one reinforcement layer has a sidewall encircling substantially all of at least one compartment.

3. The sampler device according to claim 2, wherein the sidewall is formed by an indent in the at least one reinforcement layer.

4. The sampler device according to claim 3, wherein the at least one reinforcement layer and the lower compartment layer are formed from a laminate material.

5. The sampler device according to claim 2, wherein the sidewall is formed by a hole punched through the at least one reinforcement layer.

6. The sampler device according to claim 2, wherein the at least one reinforcement layer has a raised wall attached to a base layer, wherein the raised wall forms the sidewall.

7. The sampler device according to claim 2, wherein the sidewall is formed by a raised wall attached to the lower compartment layer.

8. The sampler device according to claim 2, wherein the sidewall is formed by embossing.

9. The sampler device according to claim 2, wherein the sidewall is continuous.

10. The sampler device according to claim 1, wherein the upper compartment layer is continuous with the lower compartment layer.

11. The sampler device according to claim 1, wherein at least one reinforcement layer is attached to a separate carrier.

12. The sampler device according to claim 1, wherein the at least one reinforcement layer is permanently attached to the at least one of the upper compartment layer and the lower compartment layer.

13. A flexible sampler device comprising:

an upper compartment layer having sample barrier properties;

a lower compartment layer having sample barrier properties;

a seal attaching the upper compartment layer to the lower compartment layer, thereby forming a closed compartment for containing sample material; and at least one reinforcement layer to protect the compartment, wherein the at least one reinforcement layer has a sidewall defining an enclosure which contains substantially all of the compartment and wherein at least one of the upper compartment layer and the lower compartment layer is attached to substantially the entire sidewall of the at least one reinforcement layer.

14. The sampler device according to claim 13, wherein the reinforcement layer is attached to a separate carrier.

15. A sampler device comprising:

an upper compartment layer having sample barrier properties;

a lower compartment layer having sample barrier properties;

a seal attaching the upper compartment layer to the lower compartment layer, thereby forming at least one closed compartment for containing sample material; and at least one reinforcement layer conformably attached to at least one of the upper compartment layer and the lower compartment layer to protect at least one compartment, wherein at least one reinforcement layer has a sidewall encircling substantially all of at least one compartment, wherein the sidewall is formed by a hole punched through the at least one reinforcement layer.

16. A sampler device comprising:

an upper compartment layer having sample barrier properties;

a lower compartment layer having sample barrier properties;

a seal attaching the upper compartment layer to the lower compartment layer, thereby forming at least one closed compartment for containing sample material; and at least one reinforcement layer conformably attached to at least one of the upper compartment layer and the lower compartment layer to protect at least one compartment, wherein at least one reinforcement layer has a sidewall encircling substantially all of at least one compartment, wherein the sidewall is formed by embossing.

17. A sampler device comprising:

an upper compartment layer having sample barrier properties;

a lower compartment layer, having sample barrier properties, wherein the lower compartment layer is continuous with the upper compartment layer;

a seal attaching the upper compartment layer to the lower compartment layer, thereby forming at least one closed compartment for containing sample material; and at least one reinforcement layer conformably attached to at least one of the upper compartment layer and the lower compartment layer to protect at least one compartment, wherein at least one reinforcement layer defines an enclosure which contains substantially all of at least one compartment.

18. A sampler device comprising:

an upper compartment layer having sample barrier properties;

a lower compartment layer having sample barrier properties;

a seal attaching the upper compartment layer to the lower compartment layer, thereby forming at least one closed compartment for containing sample material;

at least one reinforcement layer conformably attached to at least one of the upper compartment layer and the lower compartment layer to protect the at least one compartment, wherein at least one reinforcement layer defines an enclosure which contains substantially all of at least one compartment; and a separate carrier attached to at least one reinforcement layer.

19. A sampler device comprising:

an upper compartment layer having sample barrier properties;

a lower compartment layer having sample barrier properties;

a seal attaching the upper compartment layer to the lower compartment layer, thereby forming a closed compartment for containing sample material;

at least one reinforcement layer to protect the compartment, wherein at least one reinforcement layer has a sidewall defining an enclosure which contains substantially all of the compartment and wherein at least one of the upper compartment layer and the lower compartment layer is attached to substantially the entire sidewall of the at least one reinforcement layer; and separate carrier attached to at least one reinforcement layer.

20. A sampler device comprising:

an upper compartment layer having generally parallel upper and lower surfaces and sample barrier properties;

a lower compartment layer having generally parallel upper and lower surfaces and sample barrier properties;

a seal attaching the lower surface of the upper compartment layer to the upper surface of the lower compartment layer, thereby forming at least one closed compartment for containing sample material; and at least one reinforcement layer conformably attached to at least one of the upper compartment layer and the lower compartment layer to protect the at least one compartment, wherein at least one reinforcement layer defines an enclosure which contains substantially all of at least one compartment.

21. The sampler device according to claim 20, wherein the seal is separable such that a user may separate at least part of the upper compartment layer from the lower compartment layer.

22. A substantially planar sampler device comprising:

an upper compartment layer having sample barrier properties;

a lower compartment layer having sample barrier properties;

a seal attaching the upper compartment layer to the lower compartment layer, thereby forming at least one closed compartment for containing sample material; and at least one reinforcement layer conformably attached to at least one of the upper compartment layer and the flexible lower compartment layer to protect the at least one compartment, wherein at least one reinforcement layer defines an enclosure which contains substantially all of at least one compartment.

23. A sampler device comprising:

an upper compartment layer having sample barrier properties;

a lower compartment layer having sample barrier properties, where the upper compartment layer is peelably sealed to the lower compartment layer, thereby forming at least one closed compartment for containing sample material; and at least one reinforcement layer conformably attached to at least one of the upper compartment layer and the lower compartment layer to protect the at least one compartment, wherein the at least one reinforcement layer defines an enclosure which contains substantially all of the at least one compartment.

24. A sampler device comprising:

an upper compartment layer having sample barrier properties;

a lower compartment layer having sample barrier properties;

a permanent seal attaching the upper compartment layer to the lower compartment layer, thereby forming at least one closed compartment for containing sample material; and at least one reinforcement layer conformably attached to at least one of the upper compartment layer and the lower compartment layer to protect the at least one compartment, wherein the at least one reinforcement layer defines an enclosure which contains substantially all of the at least one compartment, wherein at least one of the upper compartment layer and the lower compartment layer may be torn to access the sample material.

* * * * *